US009266169B2

(12) United States Patent
Steiner et al.

(10) Patent No.: US 9,266,169 B2
(45) Date of Patent: Feb. 23, 2016

(54) CLOSURE PLATE, AND A SLIDE CLOSURE ON THE SPOUT OF A CONTAINER CONTAINING MOLTEN METAL

(75) Inventors: Benno Steiner, Nebikon (CH); Reinhard Ehrengruber, Lucerne (CH)

(73) Assignee: Stopinc Aktiengesellschaft, Hunenberg (CH)

( * ) Notice: Subject to any disclaimer, the term of this patent is extended or adjusted under 35 U.S.C. 154(b) by 33 days.

(21) Appl. No.: 13/976,506

(22) PCT Filed: Jan. 24, 2012

(86) PCT No.: PCT/EP2012/000306

§ 371 (c)(1),
(2), (4) Date: Jun. 27, 2013

(87) PCT Pub. No.: WO2012/104028

PCT Pub. Date: Aug. 9, 2012

(65) Prior Publication Data

US 2013/0270308 A1 Oct. 17, 2013

(30) Foreign Application Priority Data

Jan. 31, 2011 (EP) ..... 11000737

(51) Int. Cl.

| | |
|---|---|
| ***B22D 41/00*** | (2006.01) |
| ***B22D 41/28*** | (2006.01) |
| ***B22D 41/34*** | (2006.01) |

(52) U.S. Cl.

CPC ..... *B22D 41/28* (2013.01); *B22D 41/34* (2013.01)

(58) Field of Classification Search

CPC ..... B22D 41/28; B22D 41/34
USPC ..... 222/591, 600
See application file for complete search history.

(56) References Cited

U.S. PATENT DOCUMENTS

| | | | |
|---|---|---|---|
| 4,573,616 | A | 3/1986 | Shapland |
| 6,092,701 | A | 7/2000 | Waltenspuhl et al. |
| 6,415,967 | B1 | 7/2002 | Toaldo |

FOREIGN PATENT DOCUMENTS

| | | | | |
|---|---|---|---|---|
| DE | 3522134 | A1 | | 1/1986 |
| DE | 3712698 | C1 | * | 1/1988 |
| EP | 0995524 | A1 | * | 4/2000 |
| GB | 1568654 | | * | 6/1980 |
| WO | 9805451 | A1 | | 2/1998 |
| WO | 9947296 | A1 | | 9/1999 |
| WO | 02070173 | A1 | | 9/2002 |
| WO | 2008116055 | A1 | | 9/2008 |

* cited by examiner

*Primary Examiner* — Scott Kastler
(74) *Attorney, Agent, or Firm* — Brian Roffe

(57) ABSTRACT

In a closure plate for a slide closure on the spout of a container containing molten metal, two outer longitudinal sides, a flow-through opening disposed on a central longitudinal axis of the closure plate and a closing surface passing from the latter are provided. There are formed on each of these two outer longitudinal sides, at least two shoulder surfaces serving as clamping surfaces or as centring surfaces of the closure plate which are at an angle to the longitudinal axis and tapering inward. At least on the shoulder surfaces on the side of the closing surface, adjoining outer sides are provided which are respectively at a smaller angle to the longitudinal axis than those of the shoulder surfaces.

19 Claims, 3 Drawing Sheets

CLOSURE PLATE, AND A SLIDE CLOSURE ON THE SPOUT OF A CONTAINER CONTAINING MOLTEN METAL

FIELD OF THE INVENTION

The invention relates to a closure plate for a slide closure on the spout of a container containing molten metal in which two outer longitudinal sides, a flow-through opening disposed on a central longitudinal axis of the closure plate and a closing surface passing from the latter are provided; and a slide closure for the latter.

BACKGROUND OF THE INVENTION

Generic closure plates in a slide closure are used for opening and closing the passage of molten metal. The closure plates respectively provided with a flow-through opening are therefore pressed against one another such as to form a seal, and by means of a drive the one closure plate can be moved over a defined distance from the open into a closed position and vice versa. Thus, both on the upper fixed and on the moveable closure plate closing surfaces are formed, the length of which corresponds to the adjustment distance. The closure plates are either clamped into the mechanism of the slide closure, as provided in a slide closure according to publication DE-A-35 22 134, or else are inserted in the mechanism with practically no play, as displayed by the plates disclosed in publication EP-A-1 064 155.

OBJECTS AND SUMMARY OF THE INVENTION

The object underlying the present invention is to provide a closure plate of the type mentioned at the start which, in particular with clamping on the outside, is provided with minimum dimensions and optimal clamping so that the closure plate offers a high level of reliability during operation when the closure is closed, and the outer plate dimensions are thereby, however, kept to a minimum in relation to the diameter of the flow-through opening.

According to the invention, the object is achieved by a closure plate for a slide closure on the spout of a container containing molten metal in which two outer longitudinal sides, a flow-through opening arranged on a central longitudinal axis of the closure plate and a closing surface passing from the closure plate are provided. On each of these two outer longitudinal sides, at least two shoulder surfaces are formed, serving as clamping surfaces or as centering surfaces of the closure plate which are at an angle to the longitudinal axis forming tapering of the plate. At least on the shoulder surfaces on the side of the closing surface, adjoining outer sides are provided which are respectively at a smaller angle to the longitudinal axis than those of the shoulder surfaces, or are arranged approximately parallel to the longitudinal axis.

In its embodiment according to the invention, this closure plate can have minimal dimensions because by means of these at least two shoulder surfaces in the form of clamping surfaces on each of the two outer longitudinal sides, optimal clamping of the closure plate can be achieved. Since these shoulder surfaces form tapering of the plate, the closure plate can have minimal dimensions. That these outer sides adjoining the side of the closing surface at the clamping surfaces and forming the plate end respectively have a smaller angle than that of the shoulder surfaces, sufficient reliability is guaranteed, even with repeated use of the closure plates.

BRIEF DESCRIPTION OF THE DRAWINGS

Exemplary embodiments and further advantages of the invention are described in more detail using the drawings. These show as follows.

DETAILED DESCRIPTION OF THE INVENTION

Figure 1:
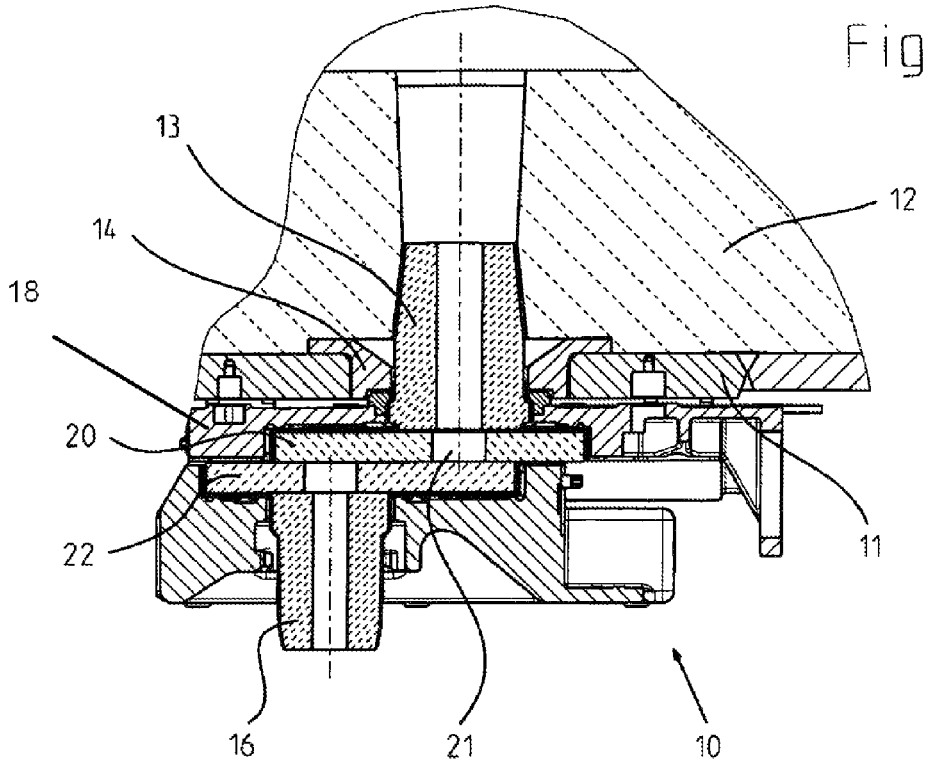
FIG. 1 is a longitudinal section of a diagrammatically illustrated slide closure and the closure plates fastened in the latter.

FIG. 1 shows a section of a slide closure 10 mounted on a container, only the outer steel jacket 11 with a centring ring 14, a fire-proof inlet sleeve 13 forming the container outlet and a fire-proof lining 12 of the container being indicated. A pan of a continuous casting plant that can be filled with molten steel is normally provided as the container. Needless to say, however, this can be a container holding any molten metal.

Adjoining this inlet sleeve 13, forming a seal, is an upper fire-proof closure plate 20 fastened in the housing 18 of the slide closure 10 and which is in sliding contact with a moveable fire-proof closure plate 22 in a slider unit (not detailed), the slider unit being moveable to and fro by a drive, and moreover being fastenable on the housing 18 by clamping components (not shown). Furthermore, there is adjoining the moveable closure plate 22 another fire-proof spout sleeve 16.

Figure 2:
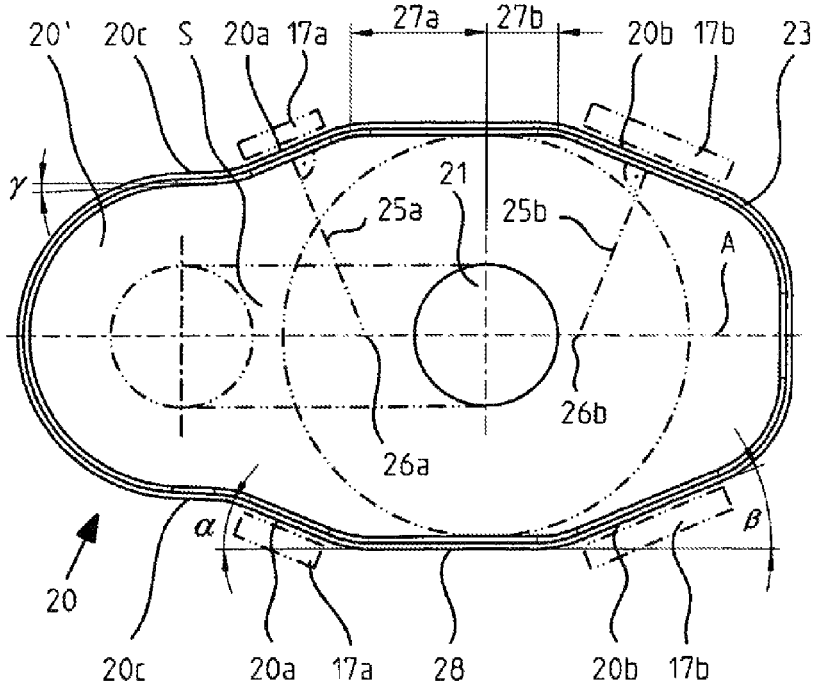
FIG. 2 is a top view of a closure plate according to the invention.

FIG. 2 shows the closure plate 20 which consists of a sheet metal jacket 23 and a fire-proof plate 20' mortared in the latter. It has two outer longitudinal sides, a flow-through opening 21 disposed on a central longitudinal axis A and a closing surface S passing from the latter. This closing surface S is defined by the diameter of the flow-through opening of the opposite closure plate and by the adjustment distance of the slider unit. In FIG. 1, the slide closure 10 is in the closed position in which the end of the closing surface of the lower moveable closure plate 22 covers, i.e., aligns with, the flow-through opening 21 of the upper closure plate 20.

According to the invention there are formed on each of these two outer longitudinal sides of the closure plate 20 two shoulder surfaces 20*a*, 20*b* serving as clamping surfaces or as centring surfaces which are at an angle $\alpha$, $\beta$ to the longitudinal axis A and thereby form tapering of the plate. Moreover, the outer sides 20*c*, which adjoin the shoulder surfaces 20*a* located on the side of the closing surface S, are respectively at a smaller angle $\gamma$ to the longitudinal axis than those of the shoulder surfaces 20*a*.

In the present exemplary embodiment, these angles $\alpha$, $\beta$ on the longitudinal sides of the closure plate 20 have the same dimensions, namely approx. 20°. However, the angle $\gamma$ of the respective outer side 20*c* is preferably between 0 and 20°, in this case approx. 5°. In relation to the longitudinal axis A the closure plate 20 is, furthermore, symmetrical in form, whereby there are the same angles and the same dimensions on both longitudinal sides.

These shoulder surfaces 20*a*, 20*b* of the closure plate 20 provided at an angle $\alpha$, $\beta$ to the longitudinal axis A are positioned a distance 27*a*, 27*b* away from the transverse axis of the flow-through opening 21. The clamping elements 17*a*, 17*b* acting on the shoulder surfaces 20*a*, 20*b* in the operating state, and which form part of the slide closure 10, and so are indicated by dots and dashes, generate a resulting clamping force line 25*a*, 25*b* extending perpendicular to the respective shoulder surface 20*a*, 20*b* towards the centre of the plate and which intersects the longitudinal axis A at the intersection point 26*a*, 26*b*.

Advantageously, within the framework of the invention the intersection point 26*a*, 26*b* formed by this respective clamping force line 25*a*, 25*b* and longitudinal axis A lies a specific distance 27*a*, 27*b* away from the outer diameter of the flow-through opening 21, i.e., a distance from a line transverse to the longitudinal axis A and passing through the center of the flow-through opening 21 as shown in FIG. 2. This distance generally corresponds to maximum twice the diameter of the flow-through opening 21 and is larger on the side of the closing surface S than on the opposite side. In FIG. 2, this distance is illustrated as smaller than this diameter of the flow-through opening.

This distance 27*a*, 27*b* between the shoulder surfaces 20*a*, 20*b* and the transverse axis of the flow-through opening 21 gives a considerable advantage in that the clamping forces acting in the region around the flow-through opening and the cracks occurring in the fire-proof material around the flow-through opening due to the thermal load do not lead to breakage of the fire-proof material. This crack formation in the fire-proof plate 20' can, however, be specifically influenced by this clamping according to the invention so that the durability of the plate is critically improved.

Furthermore, the ends of the closure plate 20 are respectively formed in the conventional manner by two radii which respectively pass from the outer side 20*c* or from the shoulder surface 20*b*. Moreover, the outer longitudinal sides in the region 28 between the shoulder surfaces are arranged parallel to the longitudinal axis. In principle the latter could also be oval or similar in shape.

Figure 3:
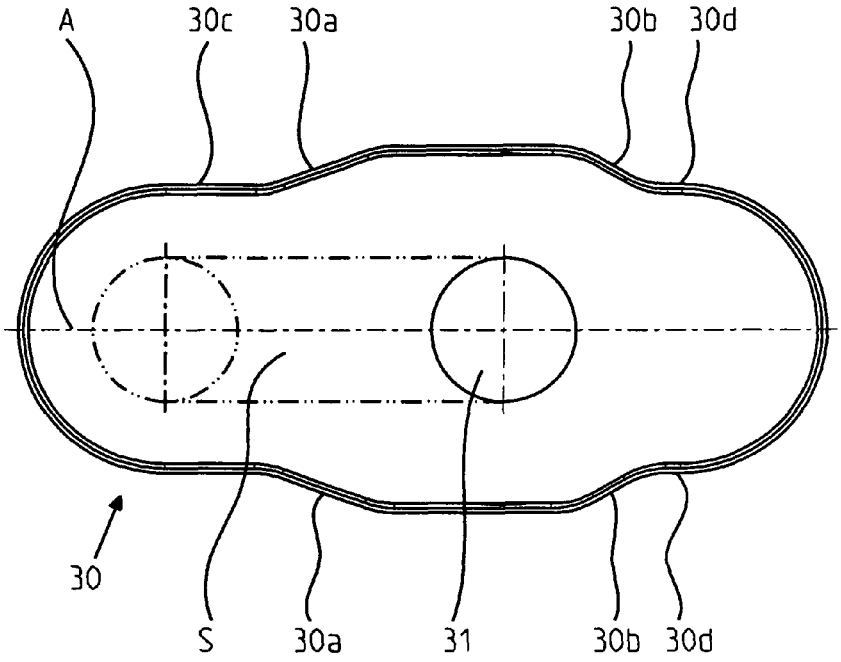
FIG. 3 is a top view of a variant of a closure plate.

FIG. 3 shows a closure plate 30 consisting of a plate and a sheet metal jacket which is similar in form to that of FIG. 2, and so in the following only the differences will be described. Two shoulder surfaces 30*a*, 30*b* are in turn respectively assigned to both outer longitudinal sides, symmetrically to the longitudinal axis A. Adjoining the two shoulder surfaces 30*b* on the side facing away from the closing surface S, outer sides 30*d* are provided which are respectively at a smaller angle to the longitudinal axis A than those of the shoulder surfaces 30*b*. These outer sides 30*d* extend, like the opposite outer sides 30*c* adjoining the shoulder surfaces 30*a*, approximately parallel to the longitudinal axis A. These outer sides 30*c*, 30*d* to both sides of the shoulder surfaces form a level plate width. The two ends on the closure plate are respectively semi-circular in shape.

Figure 4:
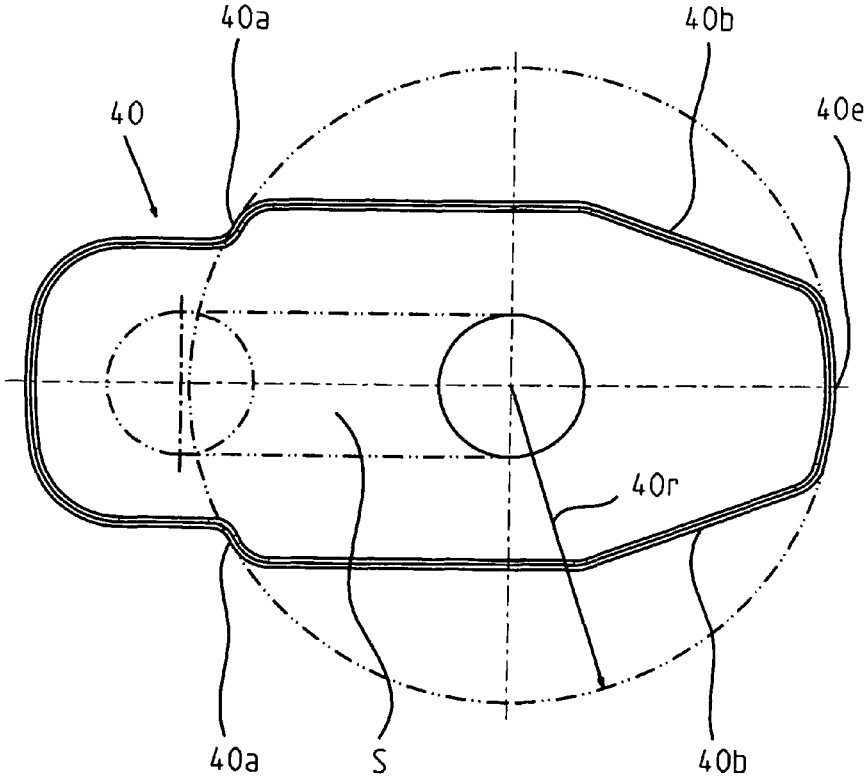
FIG. 4 is a top view of a further variant of a closure plate.

The closure plate 40 according to FIG. 4 is in turn similar in form to that according to FIG. 2, and the differences are displayed below. The shoulder surfaces 40*a* are not formed as straight surfaces, but as round surfaces. The radius 40*r* (from a center of the flow-through opening 21) is chosen here such that it practically forms the radius of the plate end 40*e* (from the center of the flow-through opening 21). The closure plate 40 could thus be inserted into a circular recess in the mechanism of the slide closure without clamping taking place. Also, as in the embodiment of FIG. 2, the shoulder surfaces 40*b* extend from a part parallel to the longitudinal axis to the plate end 40*e*.

Figure 5:
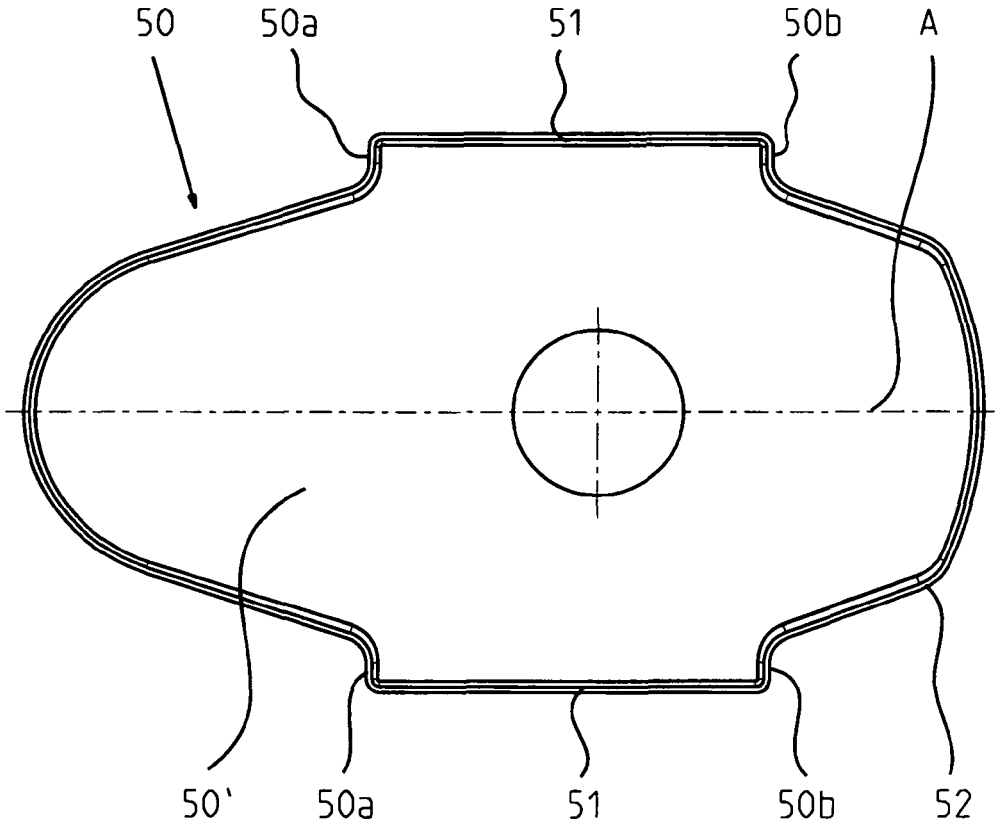
FIG. 5 is a top view of a fourth variant of a closure plate.

FIG. 5 shows a closure plate 50 in which, as a special feature, the shoulder surfaces 50*a*, 50*b* are arranged on the outer longitudinal sides at right angles to the longitudinal axis A so that these angles α, β are 90°. These shoulder surfaces 50*a*, 50*b* are preferably dimensioned with a short length of just a few millimeters, whereas in the above variants the shoulder surfaces respectively have a length of preferably 30 to 100 mm. This closure plate 50 is especially suitable for being inserted, with practically no play and without clamping, into the mechanism of the slide closure. In the mechanism corresponding recesses would have to be provided in which these centring shoulders 51 with the shoulder surfaces 50*a*, 50*b* formed on the latter would be accommodated with practically no play. The centring shoulders 51 with their shoulder surfaces 50*a*, 50*b* are formed by the sheet metal jacket 52 surrounding the fire-proof plate 50'.

These shoulder surfaces 50*a*, 50*b*, preferably dimensioned with a short length of just a few millimeters, could, however, also be formed at less than 90° to the longitudinal axis A.

The invention is sufficiently demonstrated by the above exemplary embodiments. Further variants could also be provided, however. Thus, for example, instead of a sheet metal jacket, just a sheet metal collar surrounding the plate could be inserted, or the plate could also be inserted directly into the mechanism of the slide closure and, if appropriate, be clamped within the latter.

Theoretically, at least one of the shoulder surfaces on the one longitudinal side could be of a different length to the corresponding one on the other longitudinal side or could be provided at a different angle. This could offer the advantage that when the closure plates are turned after the container has been emptied a specific number of times, and so the rear side becomes the sliding side, the latter can first of all be used as the slider plate, and after turning only as the base plate.

The invention claimed is:

1. A closure plate for a slide closure on the spout of a container adapted to contain molten metal, comprising:

a fire-proof plate defining a flow-through opening on a longitudinal axis through which molten metal operatively flows;

the closure plate including two outer longitudinal sides, a closing surface situated on one side of the flow-through opening, at least two pair of shoulder surfaces, in each pair of shoulder surfaces, one of the shoulder surfaces being formed on one of the longitudinal sides and the other shoulder surface being formed on the other longitudinal side, one pair of the at least two pair of shoulder surfaces being situated on each side of the flow-through opening along the longitudinal axis, each shoulder surface of the at least two pair of shoulder surfaces being at a respective angle to the longitudinal axis, the angle being greater than 0° and inwardly oriented such that the shoulder surfaces have an inward taper toward the longitudinal axis, and a pair of outer sides each adjoining a respective one of a first pair of the at least two pair of shoulder surfaces, the outer sides being at a smaller, greater than 0° angle to the longitudinal axis than the angle of the first pair of the at least two pair of shoulder surfaces to the longitudinal axis and which angle is inwardly oriented such that the outer sides have an inward taper toward the longitudinal axis, or such that the outer sides are arranged approximately parallel to the longitudinal axis, and wherein the closure plate includes centring shoulders between a first pair of the at least two pair of shoulder surfaces situated on the side of the closing surface and a second pair of the at least two pair of shoulder surfaces situated on a side of the flow-through opening opposite the side on which the closing surface is situated, and wherein each shoulder surface of the first and second pairs of the at least two pair of shoulder surfaces has an outer longitudinal side perpendicular to the longitudinal axis.

2. The closure plate according to claim 1, wherein the at least two pair of shoulder surfaces are a distance from a line transverse to the longitudinal axis and passing through a center of the flow-through opening such that clamping elements or bearings acting on each shoulder surface of the at least two pair of shoulder surfaces in the operating state generate a respective resulting clamping force line perpendicular to the respective shoulder surface towards a center of the closure plate, an intersection point formed by each clamping force line and the longitudinal axis lying a distance away from the line transverse to the longitudinal axis and passing through a center of the flow-through opening.

3. The closure plate according to claim 2, wherein the distance between each intersection point and the line transverse to the longitudinal axis and passing through the center of the flow-through opening is equal to or less than twice a diameter of the flow-through opening.

4. The closure plate according to claim 2, wherein the distance between each intersection point and the line transverse to the longitudinal axis and passing through the center of the flow-through opening is smaller than the diameter of the flow-through opening, and the distance between the intersection point on the side of the closing surface and the line transverse to the longitudinal axis and passing through the center of the flow-through opening is greater than the distance between the intersection point on the side of the flow-through opening opposite the side on which the closing surface is situated and the line transverse to the longitudinal axis and passing through the center of the flow-through opening.

5. The closure plate according to claim 1, further including a pair of additional outer sides each adjoining a respective one of a second pair of the at least two pair of shoulder surfaces, the second pair of shoulder surfaces being on a side of the flow-through opening opposite the side on which the closing surface is situated, each of the additional outer sides being at a smaller, greater than 0° angle to the longitudinal axis than the angle of the second pair of the at least two pair of shoulder surfaces to the longitudinal axis and which angle is inwardly oriented such that the additional outer sides have an inward taper toward the longitudinal axis or are arranged approximately parallel to the longitudinal axis.

6. The closure plate according to claim 1, wherein the first pair of the at least two pair of shoulder surfaces is situated on the side of the closing surface along the longitudinal axis.

7. The closure plate according to claim 6, further comprising a plate end on a side of the flow-through opening opposite the side to which the closing surface is situated, and wherein the first pair of the at least two pair of shoulder surfaces has round surfaces, the round surfaces having a radius from a center of the flow-through opening that is the same as the radius of the plate end from the center of the flow-through opening.

8. A slide closure, comprising:

the closure plate according to claim 1; and at least one metal frame for accommodating the closure plate, the metal frame including clamping elements that clamp the closure plate via the at least two pair of shoulder surfaces.

9. A slide closure comprising:

the closure plate according to claim 1, and at least one metal frame for accommodating the closure plate, the metal frame including at least two recesses with centring surfaces into which the closure plate is insertable.

10. The closure plate according to claim 6, wherein the first pair of the at least two pair of shoulder surfaces includes straight, round, or oval shoulder surfaces.

11. The closure plate according to claim 7, wherein a second pair of the at least two pair of shoulder surfaces is situated on a side of the closing surface opposite to the side to which the closing surface is situated, each of the second pair of the at least two pair of shoulder surfaces extending from a part of the closure plate that is parallel to the longitudinal axis to the radial end.

12. The closure plate according to claim 1, wherein each shoulder surface of the first and second pairs of the at least two pair of shoulder surfaces has a length of less than 30 mm.

13. The closure plate according to claim 1, further comprising a metal jacket arranged around the fire-proof plate.

14. The closure plate according to claim 13, wherein the metal jacket forms the at least two pair of shoulder surfaces.

15. The closure plate according to claim 13, wherein the metal jacket surrounds the fire-proof plate such that the metal jacket and fire-proof plate have the same shape as the closure plate.

16. The closure plate according to claim 1, wherein the longitudinal axis on which the flow-through opening is situated is a central longitudinal axis of the closure plate.

17. The closure plate according to claim 1, wherein the pair of outer sides are at a smaller angle to the longitudinal axis than the angle of the first pair of the at least two pair of shoulder surfaces to the longitudinal axis.

18. A closure plate for a slide closure on a spout of a container adapted to contain molten metal, comprising:

a fire-proof plate defining a flow-through opening on a longitudinal axis through which molten metal operatively flows;

the closure plate including two outer longitudinal sides, a closing surface situated on one side of the flow-through opening, at least two pair of shoulder surfaces, in each pair of shoulder surfaces, one of the shoulder surfaces being formed on one of the longitudinal sides and the other shoulder surface being formed on the other longitudinal side, one pair of the at least two pair of shoulder surfaces being situated on each side of the flow-through opening along the longitudinal axis, each shoulder surface of the at least two pair of shoulder surfaces being at a respective angle to the longitudinal axis, the angle being greater than 0° and inwardly oriented such that the shoulder surfaces have an inward taper toward the longitudinal axis, and a pair of outer sides each adjoining a respective one of a first pair of the at least two pair of shoulder surfaces, the outer sides being at a smaller, greater than 0° angle to the longitudinal axis than the angle of the first pair of the at least two pair of shoulder surfaces to the longitudinal axis and which angle is inwardly oriented such that the outer sides have an inward taper toward the longitudinal axis, and wherein the angle between each shoulder surface of the at least two pair of shoulder surfaces and the longitudinal axis is approximately 20°, and wherein each of the pair of outer sides is at an angle of about 5° to the longitudinal axis.

19. A slide closure, comprising:

a fire-proof inlet sleeve forming a container outlet;

the closure plate according to claim 1 adjoining and below the fire-proof inlet sleeve; and a movable closure plate below the closure plate, the closure plate being in sliding contact with the movable closure plate.

* * * * *